US008474154B2

(12) United States Patent
Werremeyer et al.

(10) Patent No.: US 8,474,154 B2
(45) Date of Patent: Jul. 2, 2013

(54) FOOTWEAR FOR WALKING OR RUNNING WITH ROLLING ACTION

(75) Inventors: Daniel Werremeyer, Hillsborough, NJ (US); Robert Tighe, Easton, PA (US); Tobias Schumacher, Thunstetten (CH)

(73) Assignee: Xelero Technology LLC, Hillsborough, NJ (US)

( * ) Notice: Subject to any disclaimer, the term of this patent is extended or adjusted under 35 U.S.C. 154(b) by 473 days.

(21) Appl. No.: 12/988,527

(22) PCT Filed: Apr. 1, 2009

(86) PCT No.: PCT/EP2009/053873

§ 371 (c)(1), (2), (4) Date: Oct. 19, 2010

(87) PCT Pub. No.: WO2009/130118

PCT Pub. Date: Oct. 29, 2009

(65) Prior Publication Data

US 2011/0035960 A1 Feb. 17, 2011

(30) Foreign Application Priority Data

Apr. 23, 2008 (EP) ..... 08155035

(51) Int. Cl.
*A43B 13/12* (2006.01)

(52) U.S. Cl.
USPC ..... 36/25 R; 36/30 R

(58) Field of Classification Search
USPC ..... 36/25 R, 103, 30 R, 31
See application file for complete search history.

(56) References Cited

U.S. PATENT DOCUMENTS

| | | | | |
|---|---|---|---|---|
| 4,372,059 | A | 2/1983 | Ambrose | |
| 4,757,620 | A * | 7/1988 | Tiitola | 36/28 |
| 4,815,221 | A * | 3/1989 | Diaz | 36/27 |
| 5,224,810 | A * | 7/1993 | Pitkin | 36/30 R |
| 5,579,591 | A | 12/1996 | Kousaka et al. | |
| 5,579,597 | A | 12/1996 | Stewart | |
| 5,881,478 | A * | 3/1999 | McMahon et al. | 36/144 |
| 6,782,639 | B1 * | 8/2004 | Muller | 36/28 |

(Continued)

FOREIGN PATENT DOCUMENTS

| | | |
|---|---|---|
| DE | 202005016740 | 3/2007 |
| EP | 0041201 | 12/1981 |

(Continued)

OTHER PUBLICATIONS

International Search Report for PCT/EP2009/053873.

(Continued)

*Primary Examiner* — Marie Patterson
(74) *Attorney, Agent, or Firm* — Thomas L. Adams

(57) ABSTRACT

A footwear sole assembly (10) for walking with a rolling action is described. An elastically compressible midsole element (33) is provided with a rolling element (40) situated in and extending over a portion of the length and over at least a portion of the width of the midsole element (33). The rolling element (40) consists at least partially of a resilient material and is disposed at least in that region of the midsole (33) which is opposite to the arch of the wearer's foot. This shoe offers the rolling gait advantages of the well known MBT shoe, but has a different construction which enables it to retain the outward appearance of conventional shoes such as trainers.

19 Claims, 6 Drawing Sheets

U.S. PATENT DOCUMENTS

| | | | | |
|---|---|---|---|---|
| 8,387,277 | B2 * | 3/2013 | Andriacchi et al. | 36/25 R |
| 2008/0005929 | A1 | 1/2008 | Hardy et al. | |
| 2010/0146825 | A1 * | 6/2010 | Teteriatnikov et al. | 36/30 R |

FOREIGN PATENT DOCUMENTS

| | | |
|---|---|---|
| EP | 0214431 | 3/1987 |
| EP | 0497152 | 1/1992 |
| EP | 1785048 | 5/2007 |
| EP | 1869989 | 12/2007 |
| JP | 2004166989 | 6/2004 |
| KR | 20040028899 | 4/2004 |
| WO | 0115560 | 3/2001 |

OTHER PUBLICATIONS

International Preliminary Report on Patentability for PCT/EP2009/053873.

* cited by examiner

FOOTWEAR FOR WALKING OR RUNNING WITH ROLLING ACTION

TECHNICAL FIELD

This invention relates to footwear having a sole assembly which enables a wearer to walk with a rolling action.

BACKGROUND ART

The concept of walking with a rolling action is said to come from the Masai, an ethnic group in Kenya, who move barefoot with a particularly healthy gait. Footwear enabling this particular way of walking, even when wearing shoes, has been described in the patent application document WO01/15560A1 (PCT/CH00/00412). Further information about walking with a rolling action, in particular in the field of orthopaedics, is to be found for example in the article "MBT, Orthopädieschuhtechnik 12/2004", pp. 22-28. MBT stands for "Masai Barefoot Technology".

The fundamentals of walking with a rolling action are described in the aforementioned document, therefore the benefits of walking with a rolling action and its positive effects on the human organism, in particular on the spine and the joints, will not be described here.

Prior art MBT shoes are distinguished in particular by their external shape and the composition of the undersole, the outer sole or tread. Reference is made here to FIG. 8 of the drawings corresponding substantially to FIG. 1 in the above-mentioned document WO 01/15560. In this figure, the reference numeral 2 refers to the upper part of the shoe. This upper part 2 is connected to the midsole 12 via a solid and hard, but flexible insole 10 and with a bottom surface 11. The midsole 12, which has a thickness of between 0.5 and 5 cm, is curved arcuately in the side view, and is soft and elastic. The lower surface of the midsole 12 is covered by a hard, elastic outer sole 13, which forms the actual running surface of the shoe. The insole bottom surface 11 and the outer sole 13 have a convex, arcuate or circular segmental shape.

As already mentioned, the use of such shoes influences the health of the wearer in an advantageous way. However MBT shoes also have many drawbacks, and these drawbacks are hindering widespread acceptance of the shoes in the market.

Firstly, the use of the shoe requires an initial training period of at least six weeks, during which walking is difficult and not without risk, particularly during the first few days. Secondly, prior art MBT shoes are not attractive in appearance, which discourages many potential purchasers, especially women, from buying and wearing such shoes. Furthermore, even after the wearer has learned how to walk in such shoes, it is notably more difficult to walk in them in a stable fashion, particularly on hard floors.

A further disadvantage with the prior art shoes is that the outer sole wears out quickly because it is required to be thin in order for the undersole to remain flexible during walking. Repair of a worn-out or torn outer sole is often difficult and expensive, which means that the shoes must be replaced frequently. Another disadvantage is that such shoes are difficult to stack or store, because of their particular sole shape, and therefore require considerably more storage space than conventional shoes.

The object of the present invention is to retain the advantages of walking with a rolling action while at the same time overcoming the above drawbacks. It is important that the footwear of the invention differs as little as possible in external appearance from traditional shoes. In particular, an object of the invention is to enable a controlled dynamic, rolling gait by means of a sole assembly having a substantially flat underside by means of an element located in the midsole of a shoe.

DISCLOSURE OF INVENTION

According to the invention, the mechanical parts of the shoe which enable walking with a rolling action are implemented inside the shoe. The footwear sole assembly according to the invention is defined in the characterizing part of claim 1, while embodiments of the invention are described in the dependent claims and in the following description.

It is known to place inserts into the sole of a shoe, or on the outer sole, and numerous insoles and insert elements for shoes have been described in the prior art. The inserts known in the state of the art all have a damping, deodorizing or disinfecting function, or are for adapting the shape of the shoe to the wearer's foot.

For example, the Korean published patent application KR20040028899 describes an insole with a recess in the metatarsal and heel area of the shoe, in which a hollow, shock-absorbing body is inserted in whose interior a spring element in the form of a spiral spring is located.

Japanese patent publication JP-2004-166989, discloses an ergonomically shaped insole for better support of the foot, which is supposed to have a supporting effect particularly in the heel region.

Described in the European patent application EP0497152 is a damping element which is inserted into the heel region of shoes, in particular safety shoes, for example as a component of an insole, for the purpose of damping the heel pressure.

The U.S. patent application US200810005929, for example, describes a shock-absorbing sole with one or more gas-filled compartments resulting in a spring effect, and a damper which is made of a viscoelastomeric material.

In contrast with the shoes of the prior art, the present invention proposes to put at least one rolling element into the sole assembly of a shoe. The rolling element can be placed in a recess, of form-fitting design, in the sole assembly, or the sole assembly can be designed such that it contains this rolling element in an integrated way. The rolling element thereby extends over at least a portion of the width of the shoe, and is made at least partially of an elastic material, for example an elastomer such as rubber or polyurethane.

The material of the rolling element is harder or more resilient than the material of the midsole. The hardness ratio of the two materials can be selected as desired and adapted according to need. It can thereby be ensured that the shoe behaves according to the known principle such that the walking or running with a rolling action takes place naturally. Moreover the rolling is promoted in this way.

In a special embodiment, the rolling element extends over the entire width of the midsole. Thanks to a continuous profile of the rolling element over the entire width of the shoe, greater walking stability can be ensured, in addition to an even wear of the outer sole material.

The rolling element can have different shapes. The simplest shape is that of a section of a cylinder or a cylindroid. This section of a cylinder or cylindroid can consist of solid material. It can also be hollow, however, the hollow space also being able to be filled with an elastic material. It is also conceivable to design the sole such that the inserted rolling element is visible from outside. If a hollow rolling element is used, the sole can be designed in particular such that a through hole (through a section of the sole, the rolling element and the second section of the sole) is thereby formed.

The rolling element can also be adapted to the differing shape of the right and left shoe. To this end, the rolling element can have the shape of a frustoconical section with circular or elliptical cross section. Other variants on the shape can also be used.

In other embodiments, the rolling element can have an upper surface which may be flat or curved (convex or concave). The element can thereby adapt itself better to the sole of the foot. The lower surface should be at least partially convex to enable the required rolling action. The radii of curvature of the upper surface can be the same or different as that of the lower surface.

Further details of the invention are illustrated in the following description and in the attached drawings. The advantages of the invention are also further explained, together with details of how the inventive subject matter can be varied and implemented within the scope of the claimed invention.

EMBODIMENTS OF THE INVENTION

Figure 8:
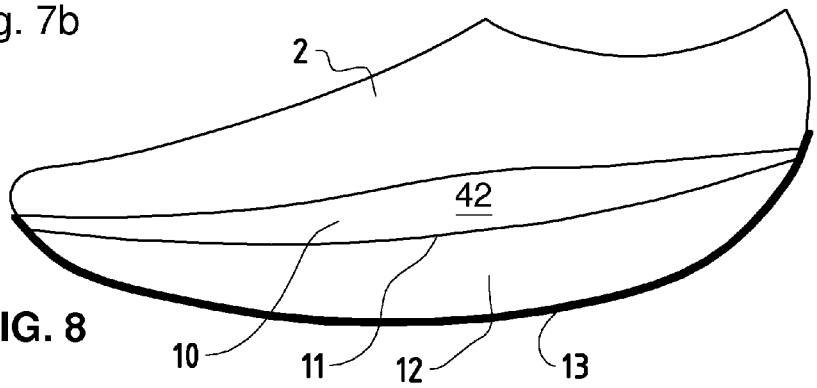
FIG. 8 illustrates a side view of an MTB shoe according to the prior art.

The shoe which inspired the present invention, the MBT shoe, is shown schematically in FIG. 8 in a lateral view. In the document PCT/CH00/00412, the MBT shoe is designated as "device for dynamic rolling walking". It consists of an upper part 2 and the composite sole assembly 10 to 13. The number 10 represents the inner sole, which is solid, hard and elastic. Located beneath it is a lower sole, 11, which separates the midsole 10 from the undersole 12, which is soft and elastic. The sole bottom 13 is in contact with the surface on which the user walks.

As described previously, the footwear sole assembly of the present invention aims to permit a similar, or improved, rolling gait to that achieved by the prior art MBT shoe illustrated in FIG. 8, but in a more conventionally-shaped sole.

The attached drawings are for illustrative purposes only, and are provided in order to aid an understanding of the invention. The figures are not intended to convey a limitation or definition of the claimed invention. The reference numbers are used consistently throughout FIGS. 1 to 7 to refer to the same items.

Figure 1:
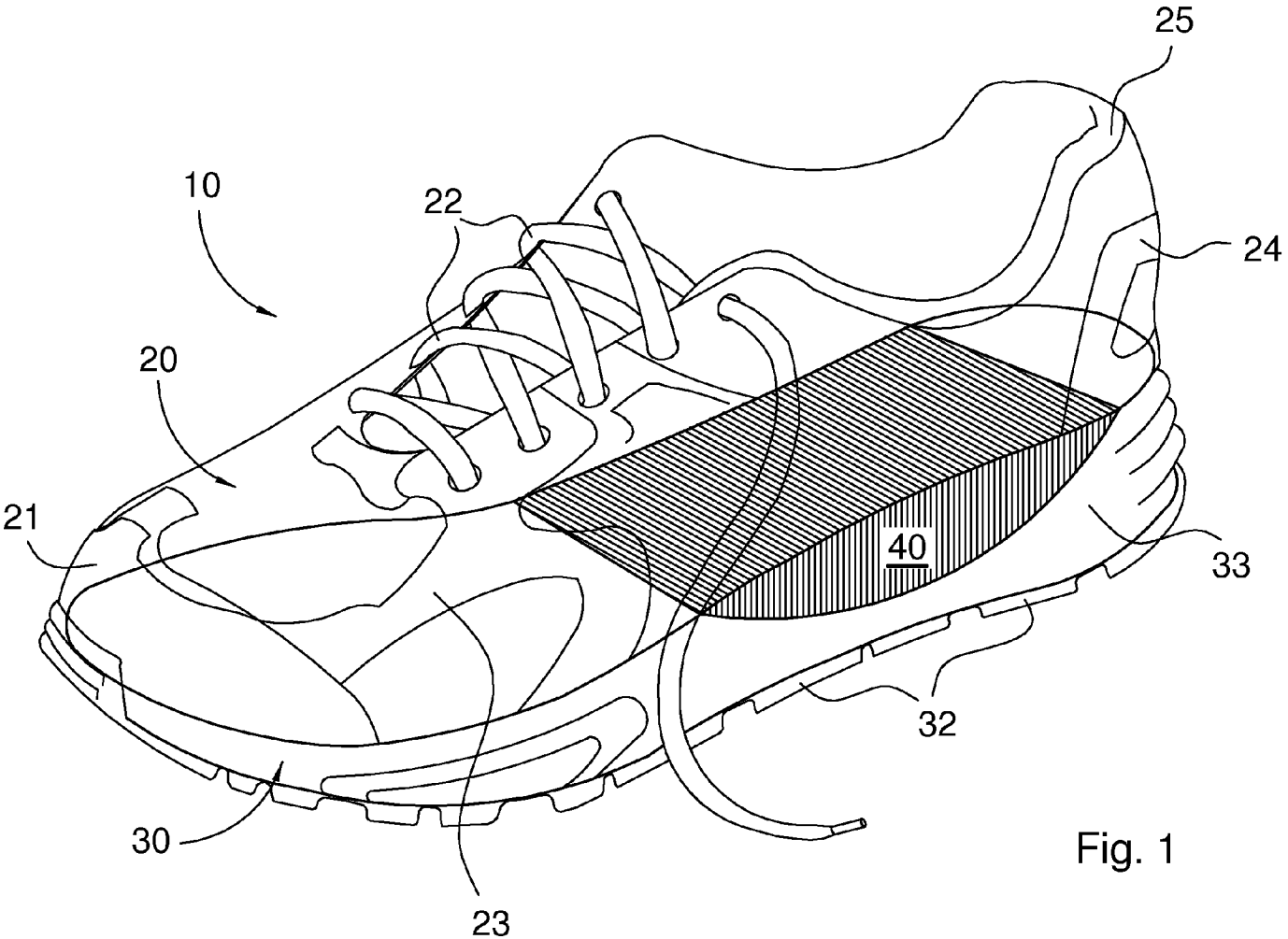
FIG. 1 illustrates a perspective view of a shoe having a sole according to the invention.

FIG. 1 shows a perspective and partially transparent view of a shoe 10 having a sole assembly according to the invention. As with most traditional shoes, there is an upper part 20 (also called an upper) with a front cap 21 and a heel portion 24 as well as lateral portions 23. The upper part 20 is connected to the sole assembly 30 in the conventional way known to a person skilled in the art. The ankle part of the upper part 20 is provided with a narrow cushion 25. As this example is an open shoe, a shoelace 22 is provided. Alternatively, instead of the shoelace 22, other fastening means may be used, such as a hook-and-loop or Velcro® closure or other similar means. The sole assembly 30 comprises a midsole part 30 and an outer sole part 32 of hard, elastic material which is not very compressible, and has small transverse tread protrusions which give the sole assembly its grip. The rear region of the sole assembly 30 terminates in a heel portion; in the shoe illustrated the outer sole is continuous without any special integrally moulded heel. Such a continuous sole is advantageous for running. The upper part 20 of the shoe can be made, as desired, of leather, textile or plastic, and can have any desirable degree of rigidity. The closure can be configured as a lace or Velcro® version, as described above.

A rolling element 40 is arranged in a recess of the sole assembly 30, and in particular in its uppermost part. This rolling element 40 and the recess are preferably shaped as a section of a cylinder or cylindroid, and the body of the sole assembly, hereafter referred to as the midsole element 33, consists at least partially of an elastic, and preferably soft, material. In principle, the rolling element 40 could consist of the same material as the sole assembly 33, however it is important for the rolling element 40 to be of a more resilient material than the midsole section 33 in which or on which the rolling element 40 is positioned. This is so that the load forces which arise during walking or running cause compression of the sole assembly in such a way that only after the midportion is initially compressed, does the rolling element 40 also begin to be compressed. The rolling element 40 can be smooth and substantially flat on its upper surface, to suit the comfort of the wearer, and its upper surface can preferably be flush with the upper surfaces of the heel region 35" and the toe region 35' of the midsole 33, as can be seen in FIG. 2.

Figure 2:
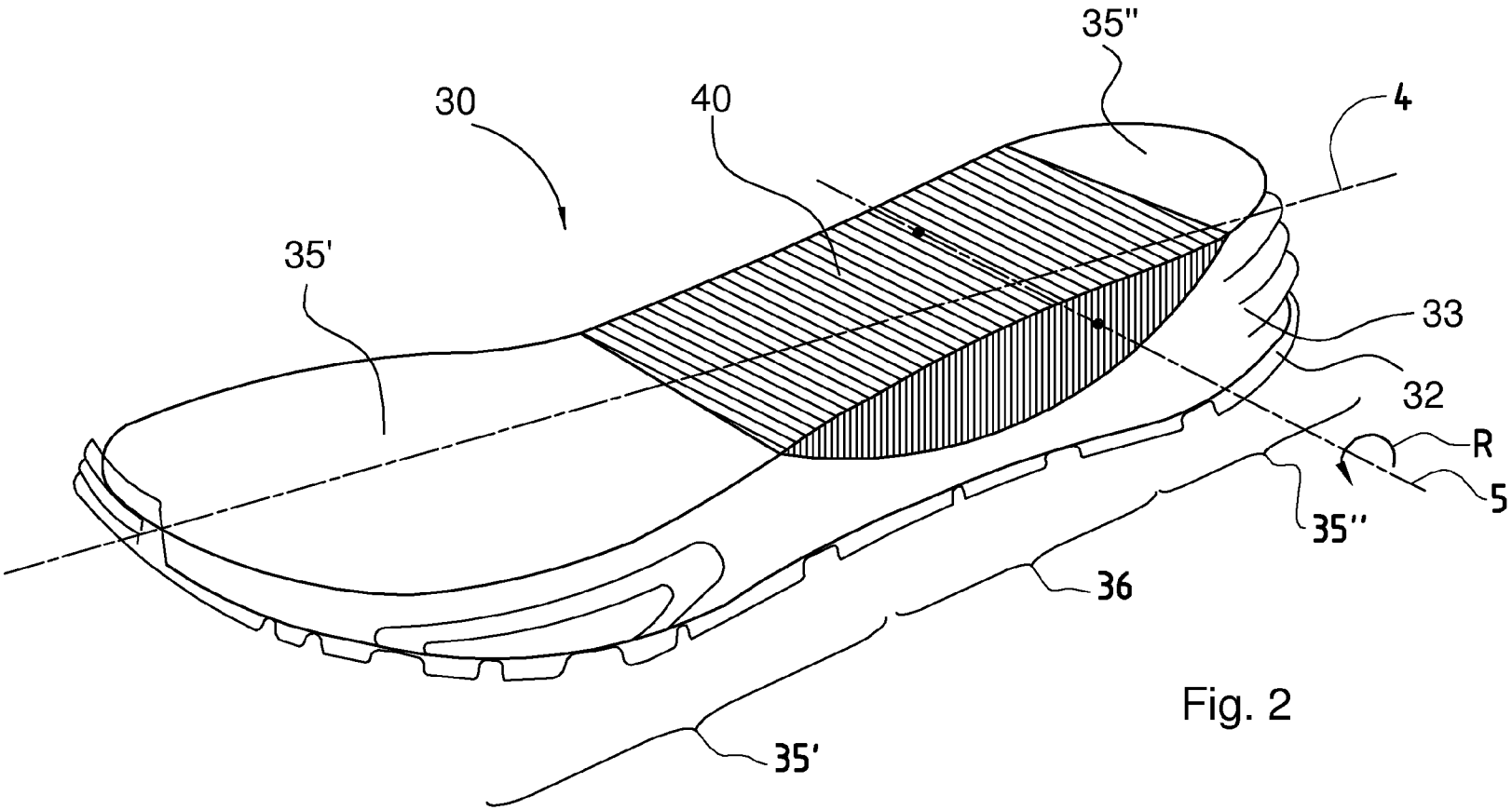
FIG. 2 illustrates a perspective view of a sole assembly according to the invention.

FIG. 2 also shows the rolling axis 5 and a longitudinal axis 4 of the sole assembly. The rolling axis 5 is included in order to indicate, in approximate fashion, the function and movement of the rolling element 40 relative to the midsole element 33. Since the elastically compressible midsole element 33 is relatively soft, and the rolling element 40 is relatively resilient, the load forces which occur during walking cause the rolling element to rotate about the rolling axis 5 running across the width of the sole assembly (ie substantially orthogonal to the longitudinal axis 4 of the sole assembly).

Constructional details of the rolling element 40 and the midsole element 33 are not described here, but it will be understood that these elements may be constructed from conventional materials such as moulded elastomers. The rolling element and the midsole element may be constructed separately and merely placed together, or they may be bonded together, or they may even be moulded out of one material, with the rolling element 40 being subsequently created within the material by a process such as a thermal or chemical process, or by injection or impregnation of the material with another substance, to provide a denser or more resilient region having the function of the rolling element 40.

The position of the rolling axis 5 shown in FIGS. 2, 3, 6 and 7 is for illustrative purposes only, and in practice the actual position of the rolling axis 5 could be anywhere—passing through the rolling element, or through the midsole assembly, or outside the sole assembly altogether. The position of the rolling axis 5 may also be different in different phases of the stride. This will depend on the shape and mechanical properties of the rolling element 40 and the midsole element 33. However the rolling axis 5 in all cases needs to be at least approximately transverse to the sole assembly (ie orthogonal to the longitudinal axis 4) to achieve the desired rolling function.

FIG. 2 also shows three functional regions of the midsole element 33 as follows:

35" represents the rearwards region of the midsole element 33, towards the heel of the sole assembly 30,

35' represents the forward region of the midsole element 33, towards the toe region of the sole assembly 30, and

36 represents a mid-portion of the midsole element, between the rear and forward regions 35' and 35", and approximately underneath the lowest section of the convex lower surface of the rolling element 40. Having a significant thickness of elastically compressible material, this mid-portion 36 performs an important role in enabling a healthy rolling action, as will be seen in FIGS. 3*a* to 3*e*. Without the elastic compression which the mid-portion 36 permits during walking or running, the wearer would be obliged to walk with a tipping action, tipping forwards over a middle part of the sole. Such a tipping, or see-saw, action is undesirable from an orthopaedic point of view, and uncomfortable for the wearer.

Note that the sole assembly illustrated in FIGS. 1, 2, 4, 6, 7*a* and 7*b* is shown in its rest state, ie without any load applied.

Some rearwards rotation of the rolling element (ie rotation of the rolling element 40 in a direction opposite to the direction R shown in FIG. 2 so as to compress the rear section 35" of the midsole element 33) may occur during the first phase of a stride (FIG. 3*a*), however it is the forwards rotation R of the rolling element 40 which is the most important in enabling the wearer to walk or run comfortable and with a rolling gait.

FIGS. 3*a* to 3*e* illustrate the five principal phases of the gait of a person wearing footwear having a sole assembly 30 according to the invention. For the sake of clarity, the references describing the rear-portion 35", the forward portion 35' and the mid-portion 36 of the sole assembly have been omitted, however it will be understood that the references 35', 36 and 35" illustrated for example in FIG. 2 also apply to FIGS. 3*a* to 3*e*.

Figures 3A, 3B, 3C, 3D, 3E:
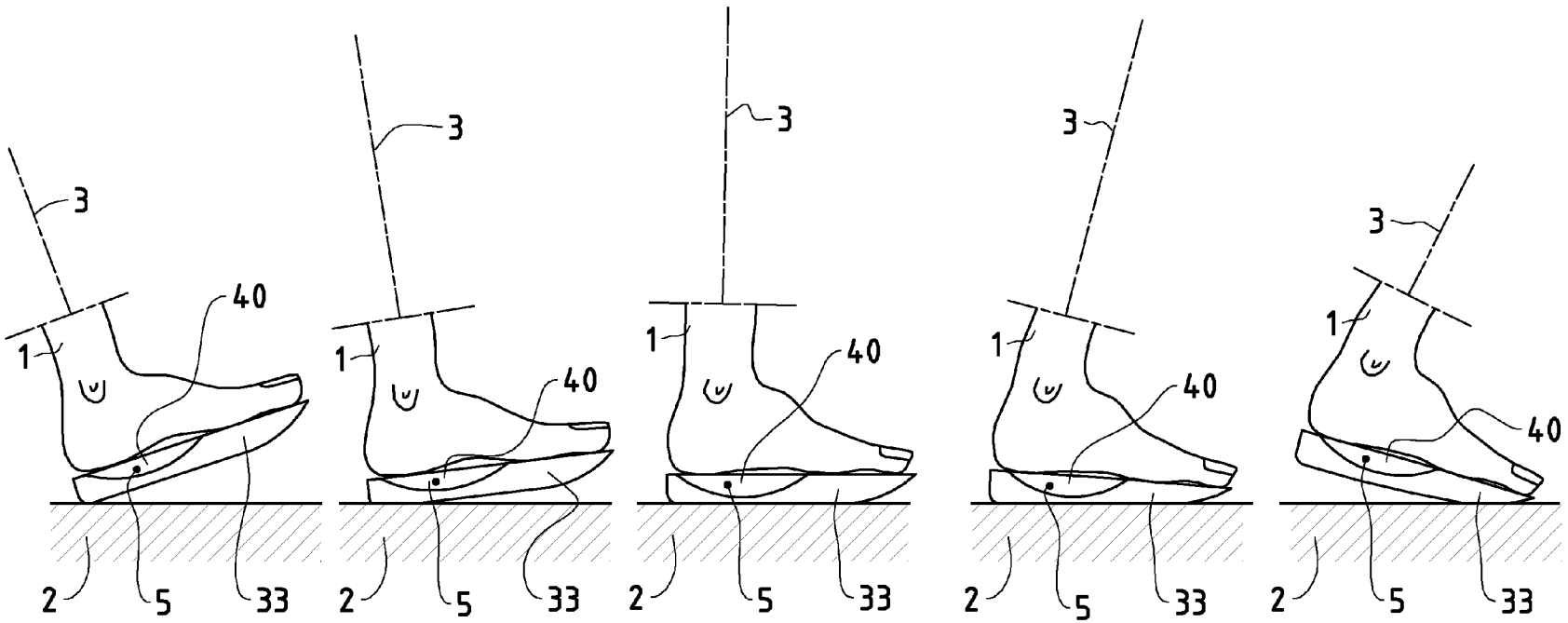
FIGS. 3*a* to 3*e* illustrate the various gait phases of a person wearing a sole assembly according to the invention.

FIG. 3*a* illustrates a first phase of a stride, in which the heel of the sole assembly 33 makes contacts with the ground 2. A sure and stable contact with the ground may be ensured by the use of a heel cap designed to grip on contact with the ground 2.

FIG. 3*b* illustrates a second phase in which the wearer begins to transfer his weight to the foot 1 shown. The rear region 35" of the sole assembly 33 is in mechanical contact with the ground 2, and absorbs the impact forces between the foot 1 and the ground 2. The resilient rolling element 40 provides additional support to the wearer's heel.

FIG. 3*c* shows the third, midstance, phase of the stride, also known as the metatarsal phase, in which the person's centre of gravity 3 is approximately vertically above over the ankle. The rolling element 40 supports the sole of the wearer's foot 1, thereby providing the wearer with guidance and control, while the mid-portion 36 of the midsole 33 provides the cushioning. The amount of compression of the mid-portion 36 shown in FIG. 3*c* is exaggerated for illustrative purposes, and in practice the mid-portion should retain significant thickness and elasticity even during the midstance phase. This compression of the mid-portion 36 during the midstance phase is an important part of the invention, and contributes significantly to a comfortable, rolling gait. Other sole constructions having an integral resilient element, as described in the prior art, are such that the integral resilient element has direct mechanical contact to the outer sole, which results in a tipping, see-saw movement. In the sole assembly of the invention, on the other hand, the opposite takes place; the midsole 33 continues to absorb the impact during the metatarsal phase.

FIG. 3*d* illustrates a fourth phase, known as the terminal stance, in which the person's center of gravity shifts forwards as a consequence of his natural gait. It is in this phase that the principal rotation of the rolling element 40 occurs. In particular, the load forces are transferred through the forward part of the rolling element 40 into the soft, elastically compressible midsole element 33. In a conventional shoe, these forces would continue to act vertically down through the sole, but in the sole assembly of the invention, the rolling element has the function of turning the load forces such that they act more in the direction of the wearer's centre of gravity 3. This turning of the load forces initiates the rolling phase of the gait, and gives the wearer the feeling of being propelled forwards as his centre of gravity moves forwards. No flexing of the sole assembly 33 as a whole occurs during this phase, and there is therefore less force on the metatarsals. Thanks to the rotation of the rolling element, less energy is needed for this phase because the shifting forwards of the body's center of gravity also helps to propel the wearer forwards.

FIG. 3*e* illustrates the fifth phase, known as the pre-swing phase, in which the foot 1 propels the wearer forwards and prepares to leave the ground. The rolling element 40 is still in the rotated position relative to the sole assembly, and thereby provides an extra propulsive effect by turning the load forces so that they propel the wearer more forwards. The slight tilted ramp provided by the rotated rolling element 40 within the sole assembly also helps to relieve the metatarsophalangeal articulation, the short plantar muscle, and the digital flexors within the wearer's foot. The body is dynamically shifted forwards and the foot takes off.

Note that the upwardly curved forward region of the outer surface of the sole assembly is also significant in contributing to the rolling gait. In FIG. 3*d*, the rolling element allows the desired rotation to take place, thereby enabling the rolling action. However this rolling is continued in FIG. 3*e*—partly by the continued rotation of the rolling element, and partly by the outer curvature of the forward region of the sole assembly. This upward curvature may be emphasized, beyond what might be expected in a conventional shoe, and in this case it is the combination of a) the rotation of the rolling element, b) the compression of the mid-portion c) the subsequent compression of the forward portion of the midsole element 33 and also d) the rounded forward region of the outer sole, which together contribute to the whole rolling gait action.

The orthopaedic advantages of this sole assembly according to the invention include the following:

- No special training is needed for the wearer.
- The sole assembly is easy to use in combination with orthopedic inserts.
- Stress on the muscles in foot and leg is reduced.
- The onset of the rolling action occurs earlier in the stride (as soon as the heel impacts the ground) than in prior art footwear.
- The function of the sole assembly acts to support the wearer's natural gait, not to change it.
- The improved rolling movement is based not on a single tipping or see-saw point. Instead, the rotation of the rolling element automatically adapts itself to the forward transfer of the wearer's centre of gravity.

Figure 4:
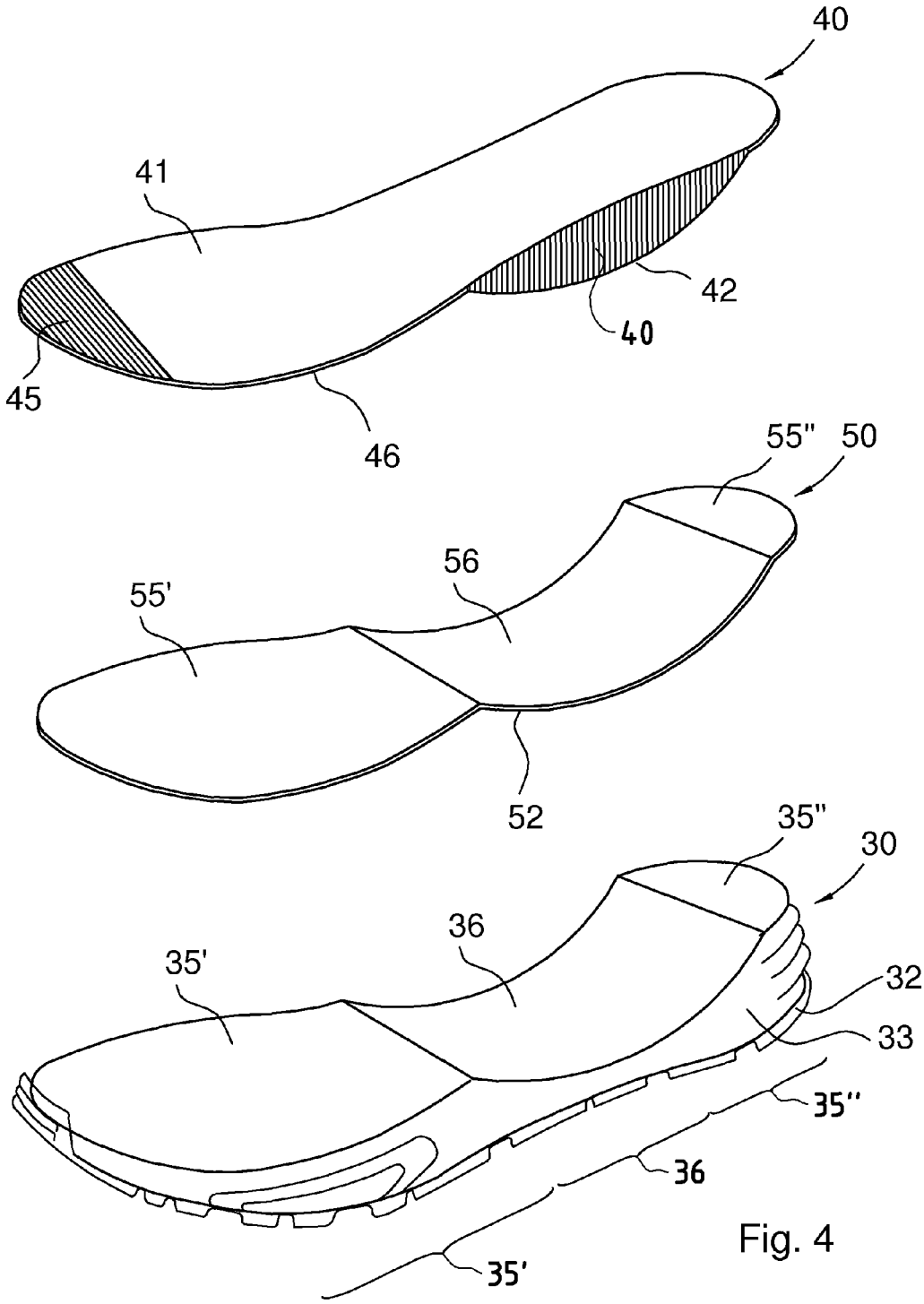
FIG. 4 illustrates an exploded perspective view of a sole assembly according to the invention.

FIG. 4 illustrates schematically a perspective view of the disassembled construction of a sole assembly 30 according to a further variant of the invention. The sole assembly 30 has a midsole element 33, which is provided underneath with tread protrusions 32. A concave recessed mid-portion 36 is provided in that region of the midsole element 33 which faces the longitudinal arch of the wearer's foot, while the forward region 35' and the heel region 35" are designed flat or only slightly curved in a concave way. On top of the midsole element 33 is an intermediate sole element 50, which is relatively thin and has a shape adapted to the shape of the regions 35', 36 and 35" of the midsole element 33, i.e. with a flat or slightly curved forward region 55', a curved middle region 56 and a flat or slightly curved heel region 55". On this intermediate sole 50, an inner sole element may be provided, comprising a substantially flat inner sole part 41 and a resilient rolling element 40 implemented as a swelling or thicker area on the lower side of the inner sole 41. As with the other embodiments of the invention described in this application, the rolling element 40 is made of a material more resilient than the material of the midsole 33. The shape of the lower side of the inner sole 41 and rolling element 40 is shaped to correspond to the shape of the intermediate sole 50. In this way the lower side 42 of the rolling element 40 fits the recessed mid-portion 36 of the midsole 33 with intermediate placement of the sole 50. The flat part of the inner sole, or the intermediate sole 50, or both, may be made from a stiff or resilient material, in order to give extra support to the wearer's foot by further distributing the load forces across the midsole. Such additional support is particularly useful for people with diabetes, for example, or rheumatism, splayfoot, or other conditions which can give rise to metatarsalgia. In one embodiment, the midsole element 33 and the intermediate sole 50 may be bonded together, while the inner sole element with rolling element 40 is inserted into the shoe without bonding. The inner sole and rolling element 40 may thereby be renewed if necessary, or replaced with an inner sole of different stiffness. The intermediate sole 50 may also be omitted altogether, with the stiffness being provided by the plate 41 of the inner sole.

Figure 5A:
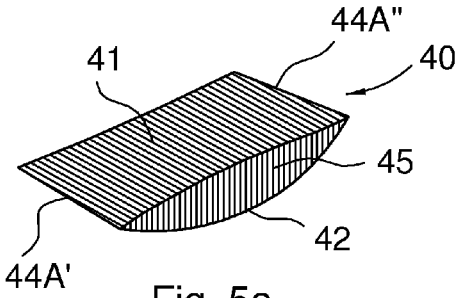
FIGS. 5A to 5*g* illustrate perspective views of various shapes of rocker elements suitable for implementing the invention.

FIGS. 5*a* to 5*g* illustrate various examples of shapes for a rolling element according to the invention. The element 40 according to FIG. 5*a* is intended for a right shoe, as with the rolling element 40 shown in FIG. 1. The lower surface 42 is convex, and the upper surface 41 is substantially flat. The leading edge 44A' extends at an angle to the lateral edges of the element 40; this angle may be approximately 90 degrees, or a different angle may be chosen. The same applies to the rear edge 44A". In this way, the lateral edge shown at the upper left of the FIG. 5*a* may be shorter than the lateral edge on the lower right. In this case, the four straight edges of the flat surface of the element form a trapezoid. This shape is advantageous because the inner middle region of a foot is arched and needs better support. In these embodiments, the rolling element 40 for the left shoe of a pair of shoes would normally be the mirror image of the rolling element as described for the right shoe. It should still be mentioned here that this special form for the rolling element 40 corresponds to the physiological particularities of the human way of walking since the foot does not roll on the ground in a way completely parallel to the direction of walking.

Figure 5B:
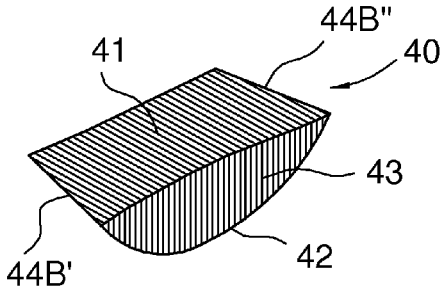

With the rolling element 40 according to FIG. 5*b*, these relative proportions may be further emphasised. Here, both the leading edge 44B' and the rear edge 44B" run at an angle to the lateral edges of the element, which are normally parallel, but are also able to enclose an angle with respect to one another. The element 40 of FIG. 5*b* has moreover a greater degree of curvature of the lower face 42.

Such a gradient for the leading edges and rear edges (i.e. at a certain angle to the lateral edges of the rolling element 40) is of course also possible and conceivable with all other described embodiments of the rolling element 40.

Figure 5C:
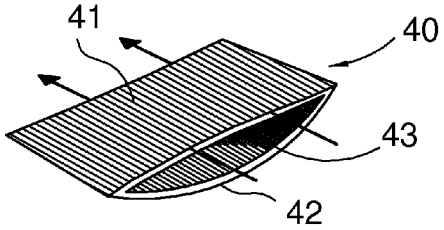

The rolling element 40 shown in FIG. 5*c* has the outer shape of the rolling element 40 in FIG. 5*a*, with the modification that it has a hollow space 45. The upper side of the element is designated again by 41, and its curved lower side by 42. The two arrows symbolize an open passage. In this rolling element, the region of the shoe bottom 30, the walls of which face the hollow space 43, can also be left open, so that air circulation in the direction of the two arrows can develop during walking (and also in the opposite direction). An aesthetic effect can also thereby be achieved, as well as a reduction in the weight of the shoe.

With the opening 43 shown, the rolling element 40 also becomes more elastic. The wall thicknesses are selected depending upon the physical features of the material in such a way that the stresses during use can be withstood. It is possible to put one or more spring elements (not shown) into the hollow space 43, if needed, to give additional resilience or elasticity. Alternatively, the hollow space 43 can be filled with a material which is harder or softer, more resilient or more elastic than the material of the rolling element itself, depending on the desired action.

Figure 5D:
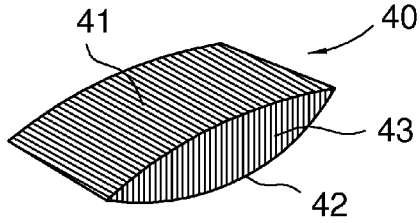

The rolling element according to FIG. 5*d* differs in that it has a slightly curved upper surface 41 and a more prominently curved convex lower surface 42. The lateral surface of the rolling element turned toward the viewer is designated by 43.

Figure 5E:
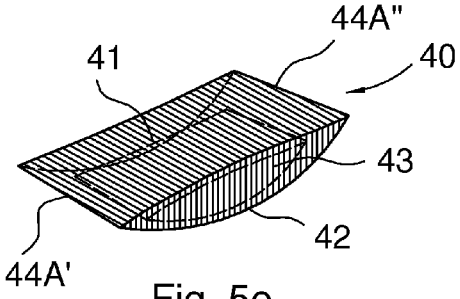

FIG. 5*e* illustrates a rolling element 40, similar to the rolling element shown in FIG. 5*c*, except that the hollow portion within the rolling element 40 is enclosed.

Figure 5G:
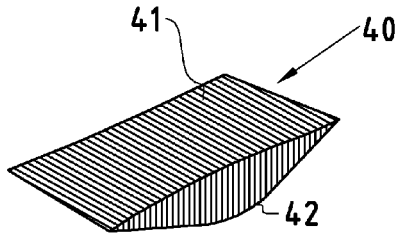
Figure 5F:
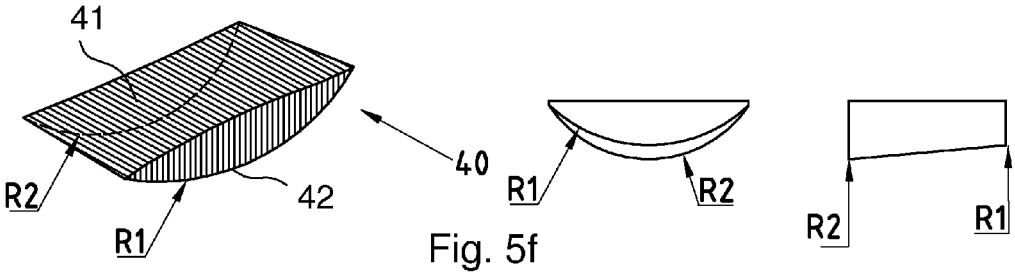

FIG. 5*f* illustrates how the radius of curvature (R1) of the outer side of the rolling element 40 may be different from the radius of curvature (R2) of the inner face. The rolling element 40 may advantageously be tapered such that the outer region is less deep than the inner region, for promoting a healthy gait. In such a case, radius R2 could be smaller than radius R1, while the thickness of the rolling element 40 on its inner side would be greater than on its outer side.

FIG. 5*g* illustrates how an irregular shape may also be used to implement the present invention. The rounded shape of the lower surface 42 shown in FIG. 5*g* would still permit the desired rolling action, in combination with a correspondingly shaped midsole.

In a further variant, which is not illustrated, a laterally-graded support is effected by, instead of (or as well as) tapering the relative thicknesses of the rolling element and the midsole, grading the relative resiliences of the rolling element and the midsole. This can be done, for example, by making the inner part of the rolling element out of a harder or more resilient material than the outer part (or vice versa). Alternatively, the inner part (the region towards the side of the insole of the wearer's foot) of the mid-portion of the midsole can be made of a more resilient material than the outer part (the region away from the wearer's insole). In all cases, however, the resilience of the rolling element material will be greater than the resilience of the midsole material. The grading of the resilience can be done stepwise (for example by using two different grades of material), or it can be continuous (for example by varying a thermal or chemical treatment across the lateral dimension of the rolling element and/or the midsole). In this way, the precise geometry of the rolling motion can be predetermined for different types of gait, or to provide extra support for sufferers of a particularly orthopaedic condition.

Figure 6:
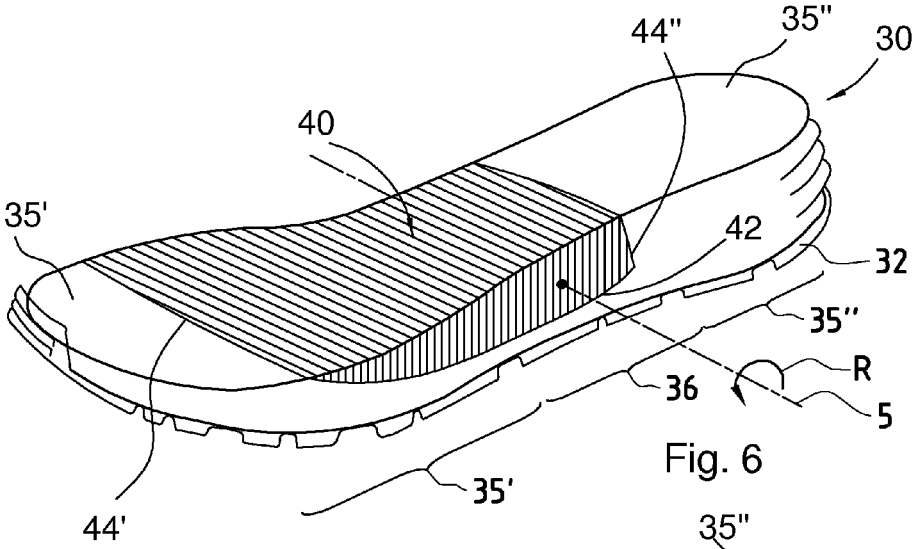
FIG. 6 illustrates a further embodiment of a sole assembly according to the invention.

FIG. 6 shows another embodiment of the invention, in which a block-shaped rolling element 40 is arranged in a corresponding recess of the midsole 33. The rolling element 40 has a slightly concave upper surface 41, a substantially flat rear surface 44" extending downward, and a lower surface 42. The lower surface 42 of the rolling element 40 thereby extends forwards from the lower edge of the rear surface 44", rises, and then up to the upper surface 41 in the area of the forward region 35', such that a forward edge 44' results. The block has a wedge-like shape whose broad face points toward the heel region 35" of the shoe.

Figure 7A:
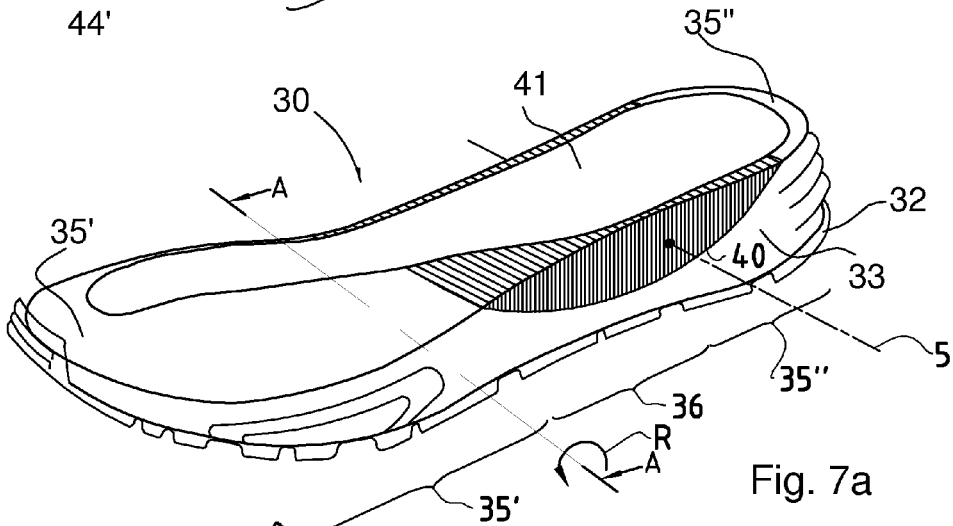
FIGS. 7*a* and 7*b* illustrates a perspective view and a section view respectively of a further embodiment of a sole assembly according to the invention, incorporating a stiff support plate.
Figure 7B:
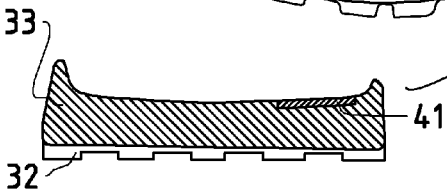

FIGS. 7*a* and 7*b* illustrates an embodiment of the invention in which an upper stiffening plate 41 is used to provide extra stiffness or elasticity in certain parts of the sole assembly. FIG. 7*b* represents a section of the sole assembly through A-A of FIG. 7*a*. Note that the stiffening plate 41 may advantageously be recessed into the upper surface of the midsole element 33 and the rolling element 40. In this case, the stiffening plate 41 helps to transfer some of the rotational forces on the rolling element 40 forwards to be absorbed in the elastically compressible material of the forward portion of the midsole 33. In the example shown, the stiffening plate 41 is made narrower in the forward region of the sole assembly and wide in the rear region, in order to support the parts of the wearer's foot which most require support. However, the precise shape of the stiffening plate can be varied depending, for example, on whether the sole assembly is designed for use in a walking or a running shoe.

The embodiments shown and discussed are only examples which are supposed to explain the invention. The invention is not limited to the features of these examples, and can be modified, simplified and further developed within the context of what has been claimed.

The invention claimed is:

1. Footwear sole assembly for enabling a wearer to walk or run with a rolling action, comprising a resilient rolling element arranged in the sole assembly, the rolling element extending along at least part of the length axis of the sole assembly and across at least part of the width of the sole assembly (5), the rolling element being arranged in the upper part of the sole assembly and extending over at least a mid-portion of the sole assembly facing the arch of the wearer's foot during walking or running, and an elastically compressible midsole element, the rolling element having a substantially convex lower rolling surface in mechanical contact with the elastically compressible midsole element and a mid-portion of the midsole element including a significant thickness of elastically compressible material underneath the lowest section of the convex lower surface of the rolling element, the rolling surface and said midsole element being shaped and arranged such that load forces incurred during walking or running cause the rolling element to rotate, relative to the sole assembly, about a rolling axis substantially transverse to the length axis of the sole assembly, thereby elastically compressing the midsole element over at least the mid-portion for at least part of a stride of the wearer.

2. Footwear sole assembly according to claim 1, in which the rolling element extends over the entire width of the midsole element.

3. Footwear sole assembly according to claim 1, in which the material of the rolling element is harder than the material of the midsole element.

4. Footwear sole assembly according to claim 3, in which the rolling element extends over the entire width of the midsole element.

5. Footwear sole assembly according to one of claims 1 to 4, in which the rolling surface has substantially the shape of a section of a cylinder.

6. Footwear sole assembly according to one of claims 1 to 4, in which the rolling surface has substantially the shape of a section of a cone, tapering along the rolling axis.

7. Footwear sole assembly according to claim 6, in which the thickness of the midsole element is tapered along the rolling axis such that the combined thicknesses of the rolling element and the midsole element remains substantially constant along the rolling axis.

8. Footwear sole assembly according to one of claims 1 to 4, in which the rolling element is at least partially hollow.

9. Footwear sole assembly according to one of claims 1 to 4, in which the rolling element is at least partially enclosed by the material of the midsole element.

10. Footwear sole assembly according to one of claims 1 to 4, further comprising a stiffening plate for diffusing said load forces across one or more of the rolling element and the midsole element.

11. Footwear sole assembly according to claim 10, in which the stiffening plate is broader in the rear region than in the forward region.

12. Footwear sole assembly according to one of claims 1 to 4, in which an upper face of the rolling element is convex.

13. Footwear sole assembly according to one of claims 1 to 4, in which the midsole element comprises:

a rear region, being a region of the midsole element from the mid-portion towards the wearer's heel, and a forward region, being a region of the midsole element from the mid-portion towards the wearer's toes, and in which that portion of the midsole element compressed by said load forces during a stride includes at least part of the forward region.

14. Footwear sole assembly according to one of claims 1 to 4, in which the rolling element is, made of a soft elastomer.

15. Footwear sole assembly according to claim 4, in which the rolling surface has substantially the shape of a section of a cylinder, and in which the rolling element is at least partially enclosed by the material of the midsole element.

16. Footwear sole assembly according to one of claims 1 to 4, further comprising:

a stiffening plate for diffusing said load forces across one or more of the rolling element and the midsole element, and in which the rolling element is at least partially hollow.

17. Footwear sole assembly according to one of claims 1 to 4, in which an upper face of the rolling element is convex, and in which the rolling element is at least partially hollow.

18. Footwear sole assembly according to one of claims 1 to 4, in which the rolling surface has substantially the shape of a section of a cylinder, and in which the rolling element is at least partially hollow.

19. Footwear sole assembly according to one of claims 1 to 4, in which the rolling surface has substantially the shape of a section of a cone, tapering along the rolling axis, and in which the rolling element is at least partially hollow.

* * * * *